US012357035B2

(12) United States Patent
Zheng et al.

(10) Patent No.: US 12,357,035 B2
(45) Date of Patent: Jul. 15, 2025

(54) BRASSIERE

(71) Applicants: Shanghai Press Technology Co., Ltd., Shanghai (CN); Shanghai Press Intimates Co., Ltd., Shanghai (CN)

(72) Inventors: Tao Zheng, Shanghai (CN); Fang Bao, Shanghai (CN)

(73) Assignee: Shanghai Press Intimates Co., Ltd., Shanghai (CN)

( * ) Notice: Subject to any disclaimer, the term of this patent is extended or adjusted under 35 U.S.C. 154(b) by 0 days.

(21) Appl. No.: 18/617,154

(22) Filed: Mar. 26, 2024

(65) Prior Publication Data

US 2024/0349822 A1 Oct. 24, 2024

(30) Foreign Application Priority Data

Apr. 18, 2023 (CN) ..... 202320875824.8

(51) Int. Cl.
*A41C 3/00* (2006.01)

(52) U.S. Cl.
CPC ..... *A41C 3/0028* (2013.01)

(58) Field of Classification Search
CPC ..... A41C 3/0028
See application file for complete search history.

(56) References Cited

U.S. PATENT DOCUMENTS

| | | | | | |
|---|---|---|---|---|---|
| 5,157,813 | A * | 10/1992 | Carroll | A43C 11/165 | 36/114 |
| 5,347,656 | A * | 9/1994 | Fabritz | A41C 3/105 | 450/38 |
| 5,833,515 | A * | 11/1998 | Shahbazian | A41C 3/105 | 450/38 |
| 7,879,091 | B1 * | 2/2011 | Martin | A61F 2/52 | 450/55 |
| 2007/0264905 | A1 * | 11/2007 | Horta | A41C 3/124 | 450/41 |
| 2010/0175163 | A1 * | 7/2010 | Litke | F16G 11/12 | 2/161.4 |
| 2013/0203319 | A1 * | 8/2013 | Torres | A41C 3/0028 | 450/59 |
| 2015/0351465 | A1 * | 12/2015 | Duraku | A41C 3/105 | 450/38 |
| 2017/0259301 | A1 * | 9/2017 | Fan | C23C 18/1241 | |
| 2024/0277079 | A1 * | 8/2024 | Lin | A41C 3/0028 | |
| 2024/0341374 | A1 * | 10/2024 | Chen | A41C 3/0028 | |
| 2024/0349822 | A1 * | 10/2024 | Zheng | A41C 3/0028 | |

* cited by examiner

*Primary Examiner* — Gloria M Hale
(74) *Attorney, Agent, or Firm* — James E. Walton

(57) ABSTRACT

A brassiere includes a front piece and a back piece bonded to the front piece, with two cup pads fixed at positions of cups between the front piece and the back piece, wherein an adjustment member and an adjustment device connected to the adjustment member are further provided within the cups, the adjustment member being provided so as to be able to change its own volume and/or position under the control of the adjustment device. The brassiere improves the practicality of the brassiere by changing sizes and positions of the cups.

19 Claims, 3 Drawing Sheets

BRASSIERE

CROSS REFERENCE TO RELATED APPLICATION

The present application claims the priority of a Chinese patent application filed with the Chinese Patent Office with an application number of 202320875824.8 on Apr. 18, 2023, titled "Brassiere," the entire contents of which are incorporated into the present application by reference for all purposes.

TECHNICAL FIELD

The application belongs to the technical field of brassiere and particularly relates to a brassiere.

BACKGROUND

Brassiere is an essential item in a woman's daily life. When choosing a brassiere, women sometimes have specific requirements for cup size. Cup sizes of existing brassiere are fixed, and when there is a need to meet a variety of needs, for example, when there is no need to increase the cup size for sports such as fitness, or when there is a need to further increase the cup size, or when there is a need to wear brassiere more loosely or more tightly, fixed-size brassiere often does not have a better practicality.

DETAILED DESCRIPTION

Figure 1:
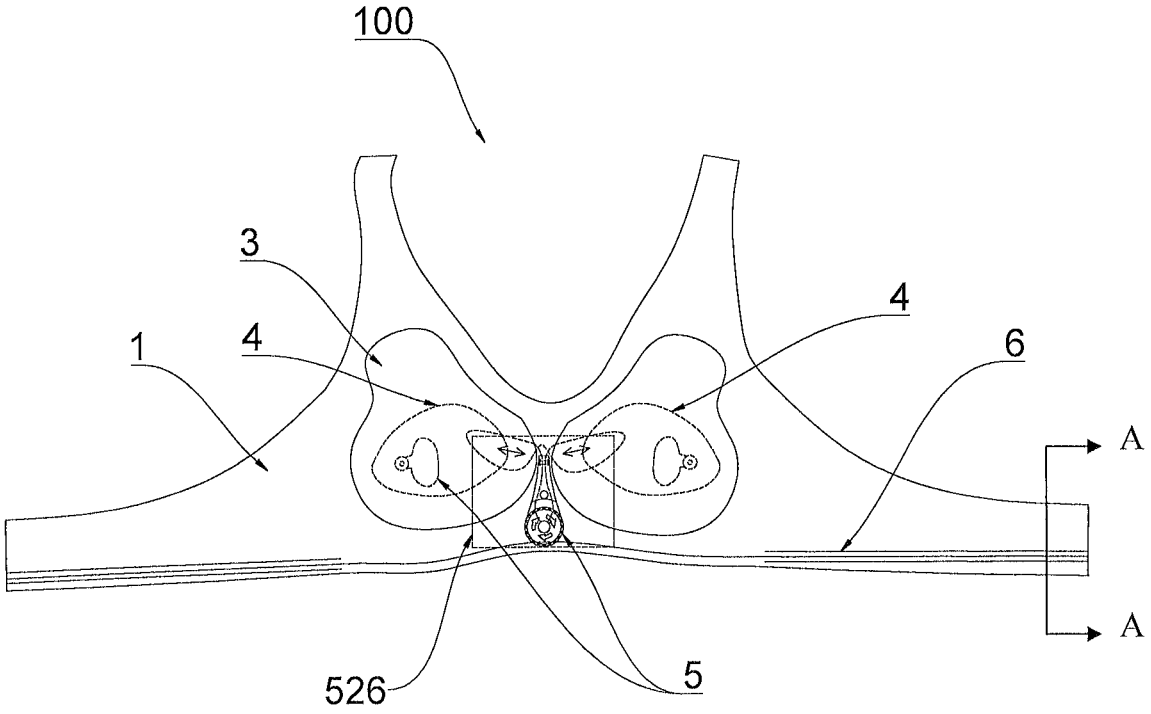
FIG. 1 is a front view structural perspective schematic diagram of some embodiments of a brassiere of an embodiment of the present application.

In order to solve all or part of the above problems, the present application provides a brassiere to improve the practicality of the brassiere by changing the size and position of the cup.

The present application provides a brassiere including a front piece and a back piece bonded to the front piece, with two cup pads fixed at positions of cups between the front piece and the back piece, wherein an adjustment member and an adjustment device connected to the adjustment member are further provided within the cups, the adjustment member being provided so as to be able to change its own volume and/or position under the control of the adjustment device.

In some embodiments, the adjustment member is movably provided or the adjustment member is fixedly connected to the cup pads.

In some embodiments, a hermetically sealed gas chamber is formed within the adjustment member, the adjustment device includes a first adjustment device, the first adjustment device is constructed as a gas-filling device provided within the gas chamber, the gas-filling device is used for filling gas into the gas chamber and releasing the gas from the gas chamber, so as to change the volume of the adjustment member.

In some embodiments, the gas-filling device is provided as a press-activated gas valve, a press portion of the press-activated gas valve is provided within the gas chamber, and a valve body of the press-activated gas valve is hermetically provided on the adjustment member.

In some embodiments, edges of the cup pads are bonded and fixed to the back piece, and the adjustment member is provided between the cup pads and the back piece, wherein an opening is formed on the back piece, and the opening is configured to install and remove of the adjustment member.

In some embodiments, the adjustment device further includes a second adjustment device, the second adjustment device including: a housing, which is fixed between the two cups of the brassiere; an adjustment wheel, which is rotationally connected to the housing through a rotating shaft; and a connecting structure, one end of which is fixed to the rotating shaft and the other end of which passes through the housing and is fixedly connected to the two adjustment members, respectively; wherein the connecting structure is capable of shortening or lengthening its own length by winding around or disengaging from the rotating shaft to drive the adjustment member to move when the adjustment wheel is rotated under the action of an external force.

In some embodiments, a winding chamber is formed between the housing and the adjustment wheel, two connecting channels connected to the winding chamber are formed at intervals on the adjustment device, and two connecting ends of the connecting structure are connected to the corresponding adjustment members through the corresponding connecting channels, respectively.

In some embodiments, the adjustment wheel is fixed to an outer surface of the front piece, the housing is fixed between the front piece and the back piece, and the rotating shaft of the adjustment wheel passes through the front piece and is connected to the housing, wherein an arrow is provided on the adjustment wheel.

In some embodiments, the brassiere further includes a fixing pad, the fixing pad being fixedly provided between the front piece and the back piece, the second adjustment device being provided between the fixing pad and the front piece, and the housing being fixed on the fixing pad.

In some embodiments, the brassiere further includes a rubber strip, the rubber strip being formed at an edge position of the cups and/or girth.

As can be seen from the above technical solutions, the brassiere according to the present application has the following advantages:

1) In the present application, by the adjustment members within the cups and the volumes of the adjustment members being able to be changed according to specific needs, the brassiere can more satisfy the needs of the user for the sizes of the cups, and the practicality of the use of the brassiere can be improved;
2) In the present application, if the size of the brassiere needs to be adjusted, the distance between the two adjustment members can be changed through the adjustment device to make the brassiere to be tighter or looser, so as to satisfy more usage needs of women for the brassiere;
3) In the present application, when a user has a simultaneous usage need to increase the cup size and wear tighter, the sizes and positions of the adjustment members can be controlled simultaneously to accommodate more usage needs of the user.

In order to better understand the purpose, structure and function of the present application, a brassiere of the present application will be described in further detail below in conjunction with the accompanying drawings.

FIG. 1 is a front view structural perspective schematic diagram of some embodiments of the brassiere 100 of an embodiment of the present application. As shown in FIG. 1, the brassiere 100 includes a front piece 1 and a back piece 2 bonded to the front piece 1 (shown in conjunction with FIG. 2), with two cup pads 3 fixed at positions of cups between the front piece 1 and the back piece 2. Adjusting members 4 and an adjustment device 5 connected to the adjustment members 4 are further provided within the cups, and the adjustment members 4 are provided so as to be able to change their own volume and/or position under the control of the adjustment device 5.

Adjustment members 4 and an adjustment device 5 are provided on the brassiere 100 of the present application, and under the action of the adjustment device 5, the adjustment members 4 are able to change their own volumes and positions. In some embodiments, the adjustment members 4 are capable of changing only their own volumes; in some other embodiments, the adjustment members 4 are capable of changing only their own positions; in other embodiments, the adjustment members 4 are capable of changing both their own volumes and their own positions. The aforementioned three kinds of embodiments may be used in conjunction with specific usage requirements. In the present application, it should be understood that the brassiere 100 includes two cup pads 3, and then should include two adjustment members 4.

In the present application, by providing adjustment members 4 within the cups and being able to change the volumes of the adjustment members 4 according to specific needs, the brassiere 100 can more satisfy the needs of the user for the sizes of the cups when worn, and the practicality of the brassiere 100 can be improved. If the size of the brassiere 100 needs to be adjusted, the distance between the two adjustment members 4 can be changed by the adjustment device 5. For example, if the size of the brassiere 100 is desired to be reduced so that it can fit more closely to a woman's body, the distance between the two adjustment members 4 can be reduced by the adjustment device 5 so that the brassiere 100 can be made tighter. Conversely, the distance between the two adjustment members 4 can then be increased by the adjustment device 5 in order to allow the brassiere 100 to be more loosely fitted, thus satisfying more usage needs of women for the brassiere 100.

In the present application, when a user needs to increase the cup size and wear tighter simultaneously, the sizes and positions of the adjustment members 4 can be controlled simultaneously to meet more usage needs of the user.

Referring continuously to FIG. 1, in some embodiments, the adjustment members 4 may be movably provided or the adjustment members 4 may be fixedly connected to the cup pads 3.

When the adjustment members 4 are movably provided, it can be understood that the adjustment members 4 are only capable of changing their own volumes. When the adjustment members 4 are fixedly connected to the cup pads 3, it can be understood that the adjustment members 4 are integral with the cup pads 3 and that the adjustment members 4 are able to change their volumes and/or positions.

Figure 3:
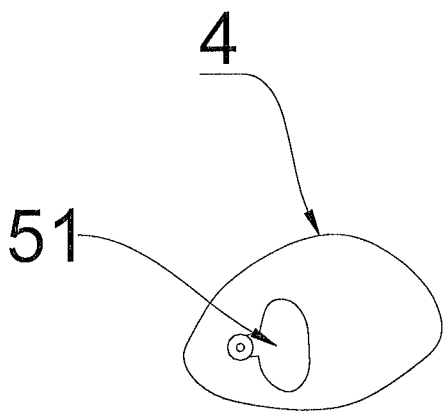
FIG. 3 is a front view structural perspective schematic diagram of an adjustment member and a first adjustment device of an embodiment of the present application.

Referring to FIG. 3, in some embodiments, a hermetically sealed gas chamber is formed within the adjustment member 4, and the adjustment device 5 may comprise a first adjustment device 51. The first adjustment device 51 is constructed as a gas-filling device 51 provided within the gas chamber, and the gas-filling device 51 is used for filling gas into the gas chamber and releasing gas from the gas chamber to change the volume of the adjustment member 4.

By means of the gas-filling device 51, it is possible to adjust the volume of the adjustment member 4 by changing gas quantity within the gas chamber. In this way, not only it is more convenient to use the adjustment member 4, but the gas filling can also greatly reduce the weight of the adjustment member 4, greatly reducing burden of wearing the brassiere 100.

In some embodiments, the gas-filling device 51 may be provided as a press-activated gas valve, press portion of the press-activated gas valve is provided within the gas chamber, and valve body of the press-activated gas valve is hermetically provided on the adjustment member 4.

The press-activated gas valve in the present application can be selected as a conventional manual press-activated gas valve. The material of the press-activated gas valve of the present application may be plastic, thereby further reducing the weight of the adjustment component 4. When in use, the valve body is able to draw in the air from the outside into the gas chamber by manually pressing the press portion, thus enabling the gas chamber to be filled with gas. When it is needed to vent air, a center vent valve of the valve body can be pressed.

In some embodiments, the press portion may be fixedly connected to a chamber wall on one side of the gas chamber to ensure fixation of the position of the press-activated gas valve.

Figure 2:
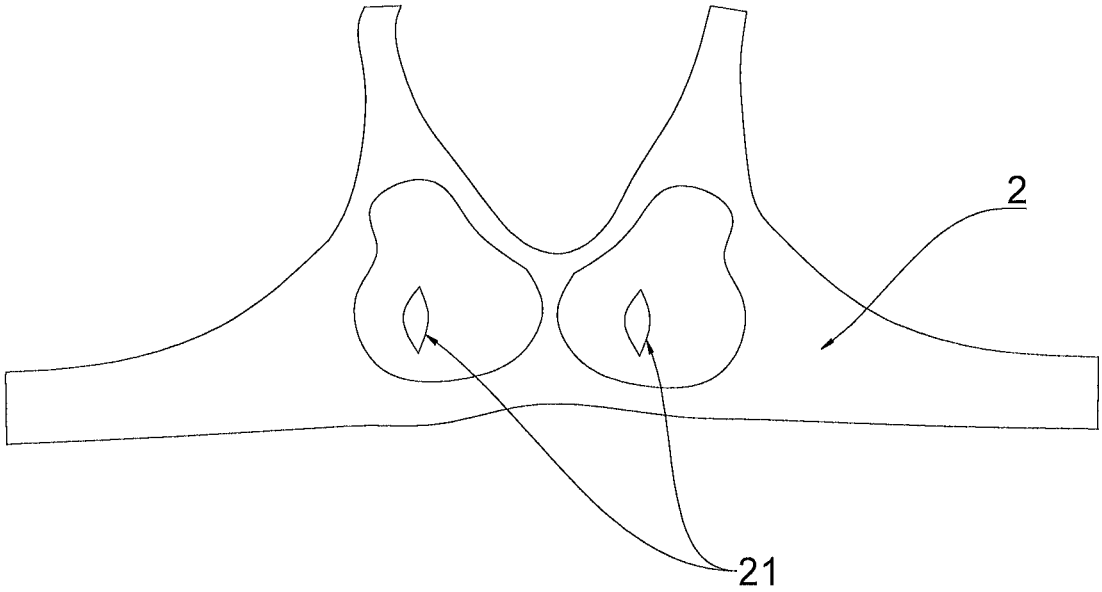
FIG. 2 is a structural schematic diagram of a back piece of an embodiment of the present application.

Referring to FIG. 2, in some embodiments, the edge of the cup pad 3 is bonded and fixed to the back piece 2, and the adjustment member 4 is provided between the cup pad 3 and the back piece 2. Openings 21 are formed on the back piece 2, and the openings 21 are configured for installing and removing the adjustment members 4.

In some embodiments, the openings 21 are located in a position proximate an edge of the rear piece 2, or, the openings 21 are located in a middle region of the back piece 2.

Figure 4:
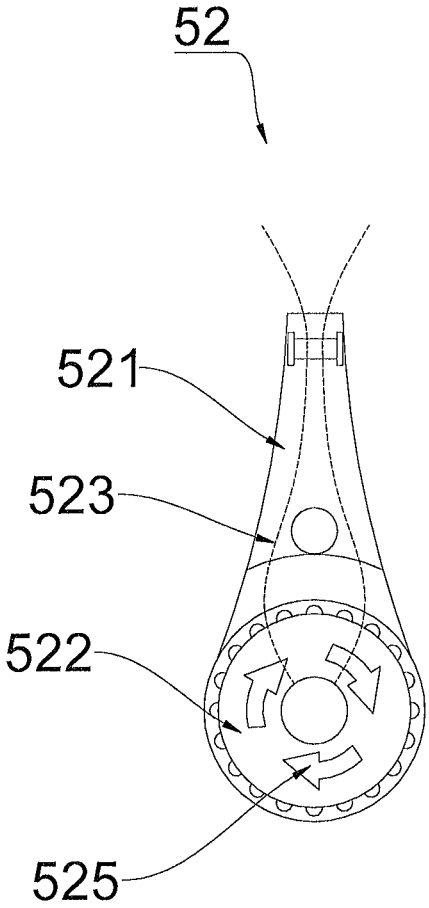
FIG. 4 is a front view structural perspective schematic diagram of a second adjustment device of an embodiment of the present application.
Figure 5:
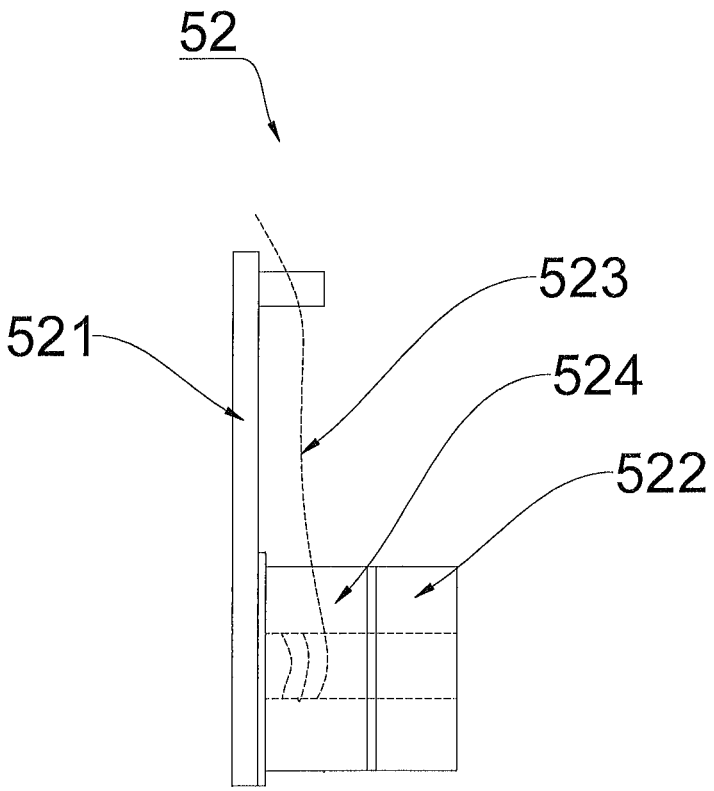
FIG. 5 is a side view structural schematic diagram of the second adjustment device shown in FIG. 4.

Referring to FIGS. 4 and 5, in some embodiments, the adjustment device 5 further includes a second adjustment device 52, the second adjustment device 52 including: a housing 521 which is fixed between the two cups of the brassiere 100; an adjustment wheel 522 which is rotationally connected to the housing 521 by a rotating shaft; as well as a connecting structure 523, one end of which is fixed to the rotating shaft, and the other end of which passes through the housing 521 and is fixedly connected to the two adjustment members 4 respectively; wherein, when the adjustment wheel 522 is rotated under the action of an external force, the connecting structure 523 is capable of shortening or lengthening its own length by winding around or disengaging from the rotating shaft, so as to drive the adjustment members 4 to move.

In the present application, after the adjustment wheel 522 is rotationally connected to the housing 521 through the rotating shaft, the rotating shaft is able to rotate synchronously while the adjustment wheel 522 is rotated. One end of the connecting structure 523 is gradually wound around the rotating shaft as the rotating shaft is rotated, thereby causing the length of the connecting structure 523 to gradually decrease and acting as a pull on the adjustment members 4. When it is needed to reset the positions of the adjustment members 4, or to further increase the distance between the two adjustment members 4, the adjustment wheel 522 can be rotated in the reverse direction to lengthen the length of the connecting structure 523, and the connecting structure 523 is able to drive the adjustment members 4 to move away from each other after the length is lengthened, and thus the distance between the two adjustment members 4 can be increased.

Alternatively, the adjustment members 4 in the present application can be fixedly connected to the cup pads 3 to enable the adjustment members 4 to drive the fixed cup pads 3 to deform as the adjustment members 4 change positions, so as to tighten the brassiere 100.

Referring to FIG. 5, in some embodiments, a winding chamber 524 is formed between the housing 521 and the adjustment wheel 522, two connecting channels connected to the winding chamber 524 are formed at intervals on the adjustment device 52, and two connecting ends of the connecting structure 523 are connected to the corresponding adjustment members 4 respectively through the corresponding connecting channels.

The winding chamber 524 in the present application may be configured to accommodate the winding connecting structure 523 not to affect the overall appearance of the brassiere 100 during the adjustment process. In the present application, by the connecting channels, the two connecting ends of the connecting structure 523 have their respective connecting channels, which can effectively avoid interference or entanglement of the two connecting ends, and make the adjustment process of the second adjustment device 52 stable and reliable.

In some embodiments, the connecting structure 523 may be constructed as a wire or rope. The wire is preferred, because the wire has a stronger structural strength and its ability to wind better is accompanied by a superior outward thrust. Of course, a rope made of special materials can also bring the above advantages.

In some embodiments, the adjustment wheel 522 may be fixed to an outer surface of the front piece 1, the housing 521 is fixed between the front piece 1 and the back piece 2, and the rotating shaft of the adjustment wheel 522 passes through the front piece 1 to be connected to the housing 521, wherein an arrow 525 is provided on the adjustment wheel 522.

With this provision, the winding direction can be quickly recognized by the direction of the arrow 525, making the adjustment process of the second adjustment device 52 quicker.

Referring back to FIG. 1, in some embodiments, a fixing pad 526 is further configured. The fixing pad 526 is fixedly provided between the front piece 1 and the back piece 2, the second adjustment device 52 is provided between the fixing pad 526 and the front piece 1, and the housing 521 is fixed to the fixing pad 526.

With this provision, the fixing pad 526 can be used to fit with the human body more comfortably, which can directly improve the comfort of wearing the brassiere 100 provided with the second adjustment device 52.

Referring continuously to FIG. 1, in some embodiments, the brassiere 100 may further include a rubber strip 6, which may be formed at an edge location of the cups and/or girth.

Figure 6:
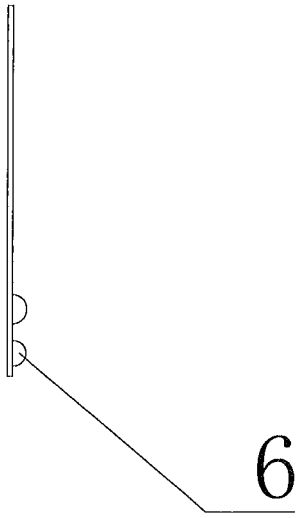
FIG. 6 is a view of the brassiere shown in FIG. 1 in a direction A-A.

As shown in conjunction with FIGS. 1 and 6, the brassiere 100 of the embodiment of the present application is formed with a rubber strip 6 at the edges of the cups and/or the girths, and the rubber strip 6 is less elastic compared to the fabric of the brassiere 100 itself, so that the rubber strip 6 is able to make the edges of the cups and/or the girth tighter after the brassiere 100 is worn, so as to enable the edges of the brassiere 100 to be more closely fitted with the human body.

By the above-described provision, compared with the prior art, on the one hand, the tightened edges of the brassiere 100 of the embodiment of the present application make the brassiere 100 less prone to shifting after the brassiere 100 is worn, so that the comfort and safety of the brassiere 100 can be effectively improved. On the other hand, the rubber strip 6 formed at the edge of the girth is also capable of providing a good lifting effect on breasts of a woman, so that the brassiere 100 of the embodiment of the present application is also capable of providing a shaping effect. In addition, the rubber strip 6 may be constructed to be transparent or of other colors, which not only will not affect the overall aesthetics of the brassiere 100, but also to a certain extent can play a better decorative effect, further improving the aesthetics of the brassiere 100.

Referring continuously to FIG. 1, in some embodiments, a plurality of parallel rubber strips 6 may be formed at intervals along the edge of the girth.

In the present application, a plurality of parallel rubber strips 6 formed at intervals at the edge of the girth can effectively improve the tightening strength of the girth, and since the girth is in a position where shifting is more likely to occur, through this provision, the fixing effect of the girth can be further improved, thereby further improving the safety and aesthetics of the brassiere 100 of the present application when in use.

Referring continuously to FIG. 1, in some embodiments, a single rubber strip 6 may be formed at the edge of the cup.

In the present application, the cup is in a position where shifting is less likely to occur, therefore, the formation of a single rubber strip 6 can satisfy the role of the edge of the cup to tighten and fit the human body more closely, and the single rubber strip 6 can also avoid the problem of formation of traces on the surface of the human body and affecting the aesthetics, which is caused by the formation of a large area of contact with the human body.

In some embodiments, the rubber strip 6 may be processed by hot melt extrusion.

It should be noted that, unless otherwise indicated, technical terms or scientific terms used in the present application should have the ordinary meaning as understood by a person skilled in the field to which the present application belongs.

In the description of the present application, it should be understood that the terms "front", "back" and the like indicate orientations or positional relationships that are based on those shown in the accompanying drawings, which are only intended to facilitate the description of the present application and to simplify the description, and are not intended to indicate or imply that the referenced device or element must have a particular orientation, be constructed and operated in a particular orientation, and therefore cannot be construed as a limitation of the present application.

Finally, it should be noted that the above embodiments are only used to illustrate the technical solutions of the present application and are not limitation thereof. Although the present application has been described in detail with reference to the foregoing embodiments, a person of ordinary skill in the art should understand that he or she may still modify the technical solutions disclosed in the foregoing embodiments or replace some or all of the technical features therein with equivalent ones; and these modifications or replacements do not cause the essence of the corresponding technical solutions to be out of the scope of the technical solutions of the respective embodiments of the present application, and they should all be covered in the scope of the claims and the specification of the present application. In particular, the respective technical features mentioned in the respective embodiments can be combined in any way as long as there is no structural conflict. The present application is not limited to the particular embodiments disclosed herein, but includes all technical solutions falling within the scope of the claims.

What is claimed is:

1. A brassiere, wherein fabric of the brassiere is a double-layer structure formed by bonding an inner layer and an outer layer together, the brassiere comprises two cups, a girth and two shoulder straps, a cup pad is fixed between a front piece as the outer layer and a back piece as the inner-layer at each of the two cups, an adjustment member is provided between the cup pad and the back piece, a hermetically sealed gas chamber is formed within the adjustment member, a first adjustment device serving as a gas-filling device is provided within the gas chamber, and the gas-filling device is used for filling gas into the gas chamber and releasing the gas from the gas chamber, to change volume of the adjustment member.

2. The brassiere according to claim 1, wherein the adjustment member is movable relative to the cup pads.

3. The brassiere according to claim 2, wherein the gas-filling device is provided as a press activated gas valve, a press portion of the press activated gas valve being provided within the gas chamber, and a valve body of the press activated gas valve being sealingly provided on the adjustment member.

4. The brassiere according to claim 2, wherein edges of the cup pad are bonded and fixed to the back piece; and wherein an opening is formed on the back piece and is configured to install and remove the adjustment member.

5. The brassiere according to claim 3, wherein edges of the cup pad are bonded and fixed to the back piece; and wherein an opening is formed on the back piece and is configured to install and remove the adjustment member.

6. The brassiere according to claim 2, wherein a second adjustment device is arranged between the two cups, the second adjustment device comprises:

a housing, which is fixed between the two cups of the brassiere;

an adjustment wheel, which is rotationally connected to the housing through a rotating shaft; and a connecting structure as a wire or a rope, one end of which is fixed to the rotating shaft and the other end of which passes through the housing and is fixedly connected to the two adjustment members respectively;

wherein the connecting structure is capable of shortening or lengthening its own a length of the connecting structure by winding around or disengaging from the rotating shaft to drive the adjustment member to move when the adjustment wheel is rotated under action of an external force, to change positions of the two adjustment members.

7. The brassiere according to claim 1, wherein a second adjustment device is arranged between the two cups, the second adjustment device comprises:

a housing, which is fixed between the two cups of the brassiere;

an adjustment wheel, which is rotationally connected to the housing through a rotating shaft; and a connecting structure as a wire or a rope, one end of which is fixed to the rotating shaft and other end of which passes through the housing and is fixedly connected to the two adjustment members respectively;

wherein the connecting structure is capable of shortening or lengthening a length of the connecting structure by winding around or disengaging from the rotating shaft to drive the adjustment member to move when the adjustment wheel is rotated under action of an external force, to change positions of the two adjustment members.

8. The brassiere according to claim 3, wherein a second adjustment device is arranged between the two cups, the second adjustment device comprises:

a housing, which is fixed between the two cups of the brassiere;

an adjustment wheel, which is rotationally connected to the housing through a rotating shaft; and a connecting structure as a wire or a rope, one end of which is fixed to the rotating shaft and the other end of which passes through the housing and is fixedly connected to the two adjustment members respectively;

wherein the connecting structure is capable of shortening or lengthening a length of the connecting structure by winding around or disengaging from the rotating shaft to drive the adjustment member to move when the adjustment wheel is rotated under action of an external force, to change positions of the two adjustment members.

9. The brassiere according to claim 6, further comprising:

a winding chamber formed between the housing and the adjustment wheel;

two connecting channels connected to the winding chamber formed at intervals on the second adjustment device; and two ends of the connecting structure connected to corresponding adjustment members through the corresponding connecting channels, respectively.

10. The brassiere according to claim 7, further comprising:

a winding chamber formed between the housing and the adjustment wheel;

two connecting channels connected to the winding chamber formed at intervals on the second adjustment device; and two ends of the connecting structure connected to corresponding adjustment members through the corresponding connecting channels, respectively.

11. The brassiere according to claim 8, further comprising:

a winding chamber formed between the housing and the adjustment wheel;

two connecting channels connected to the winding chamber formed at intervals on the second adjustment device, and two ends of the connecting structure connected to corresponding adjustment members through the corresponding connecting channels, respectively.

12. The brassiere according to claim 6, wherein the adjustment wheel is fixed to an outer surface of the front piece, the housing is fixed between the front piece and the back piece, and the rotating shaft of the adjustment wheel passes through the front piece and is connected to the housing; and wherein an arrow is provided on the adjustment wheel.

13. The brassiere according to claim 7, wherein the adjustment wheel is fixed to an outer surface of the front piece, the housing is fixed between the front piece and the back piece, and the rotating shaft of the adjustment wheel passes through the front piece and is connected to the housing;

wherein an arrow is provided on the adjustment wheel.

14. The brassiere according to claim 8, wherein the adjustment wheel is fixed to an outer surface of the front piece, the housing is fixed between the front piece and the back piece, and the rotating shaft of the adjustment wheel passes through the front piece and is connected to the housing;

wherein an arrow is provided on the adjustment wheel.

15. The brassiere according to claim 6, further comprising:

a fixing pad fixedly provided between the front piece and the back piece;

wherein the second adjustment device is provided between the fixing pad and the front piece, and the housing is fixed on the fixing pad.

16. The brassiere according to claim 7, further comprising:

a fixing pad fixedly provided between the front piece and the back piece;

wherein the second adjustment device is provided between the fixing pad and the front piece, and the housing is fixed on the fixing pad.

17. The brassiere according to claim 8, further comprising:

a fixing pad fixedly provided between the front piece and the back piece;

wherein the second adjustment device is provided between the fixing pad and the front piece, and the housing is fixed on the fixing pad.

18. The brassiere according to claim 1, further comprising:

a rubber strip formed at an edge position of the cups and/or girth.

19. The brassiere according to claim 1, wherein the adjustment member is fixedly connected to the cup pads.

* * * * *